United States Patent [19]

Nakaoka et al.

[11] 4,336,080

[45] Jun. 22, 1982

[54] METHOD FOR MANUFACTURING HIGH-STRENGTH COLD-ROLLED STEEL STRIP EXCELLENT IN PRESS-FORMABILITY

[75] Inventors: Kazuhide Nakaoka, Yokohama; Akihiko Nishimoto, Isehara; Yoshihiro Hosoya, Yokohama, all of Japan

[73] Assignee: Nippon Kokan Kabushiki Kaisha, Tokyo, Japan

[21] Appl. No.: 208,537

[22] Filed: Nov. 20, 1980

[30] Foreign Application Priority Data

Dec. 14, 1979 [JP] Japan ..... 54-161615

[51] Int. Cl.[3] ..... C21D 8/04

[52] U.S. Cl. ..... 148/12 C; 148/12 F; 148/12.4; 148/144

[58] Field of Search ..... 148/12 F, 12 C, 12 D, 148/12.3, 142, 12.4, 144

[56] References Cited

U.S. PATENT DOCUMENTS

| | | | |
|---|---|---|---|
| 3,904,446 | 9/1975 | Uchida et al. | 148/12.3 |
| 3,936,324 | 2/1976 | Uchida et al. | 148/12.3 X |
| 4,050,959 | 9/1977 | Nakaoka et al. | 148/12.3 |
| 4,145,235 | 3/1979 | Gondo et al. | 148/142 X |

*Primary Examiner*—Peter K. Skiff

*Attorney, Agent, or Firm*—Frishauf, Holtz, Goodman & Woodward

[57] ABSTRACT

A method for manufacturing a high-strength cold-rolled steel strip excellent in press-formability, which comprises the steps of: preparing a slab of an aluminum-killed steel consisting essentially of, in weight percentage:

| | | |
|---|---|---|
| Carbon | from 0.02 | to 0.06%, |
| Manganese | from 0.06 | to 0.25%, |
| Phosphorus | from 0.01 | to 0.06%, |
| Soluble aluminum | from 0.020 | to 0.060%, |
| Nitrogen | up to 0.005%, and | |

the balance iron and incidental impurities;

hot-rolling said slab to prepare a hot-rolled steel strip; coiling said steel strip at a temperature within the range of from 650° to 770° C.; cold-rolling said hot-rolled steel strip thus coiled to prepare a cold-rolled steel strip; subjecting said cold-rolled steel strip to a continuous annealing treatment for a prescribed period of time at a temperature within the range of from 750° to 880° C.; cooling said cold-rolled steel strip continuously annealed at a cooling rate of at least: exp $\{-5.6$ (Cwt. $\%\gamma$+Mn wt. %/6+Si wt. %/24)+7.8$\}$ °C./sec from a temperature region of from $Ar_3$ to $Ar_1$+60° C. to convert the structure thereof into a dual-phase structure of ferrite and a low-temperature transformation phase; and then, subjecting said cold-rolled steel strip having said dual-phase structure to an over-ageing treatment for a prescribed period of time at a temperature within the range of from 260° to 360° C.

9 Claims, 5 Drawing Figures

METHOD FOR MANUFACTURING HIGH-STRENGTH COLD-ROLLED STEEL STRIP EXCELLENT IN PRESS-FORMABILITY

REFERENCE TO PATENTS, APPLICATIONS AND PUBLICATIONS PERTINENT TO THE INVENTION

As far as we know, there is the following prior document pertinent to the present invention:

(1) Japanese Patent Publication No. 41,983/79 dated Dec. 11, 1979.

The contents of the prior art disclosed in the above-mentioned prior document (1) will be described hereinbelow under the caption of the "BACKGROUND OF THE INVENTION".

FIELD OF THE INVENTION

The present invention relates to a method for manufacturing a high-strength cold-rolled steel strip excellent in press-formability and having a tensile strength of from 35 to 50 kg/mm$^2$.

BACKGROUND OF THE INVENTION

In recent years, reduction of the automobile body weight is demanded as one of the measures to reduce fuel consumption. For the purpose of reducing the car body weight, it is requested to reduce the thickness of the cold-rolled steel sheet, which accounts for about 40% of the car body weight among the component members of the car body, by increasing tensile strength thereof and imparting a higher dent resistance thereto.

Conventionally, such a high-strength cold-rolled steel sheet has been manufactured either by a method comprising subjecting a cold-rolled steel strip added with solid-solution element to a batch annealing and strengthening said strip by the effect of this solid-solution element, or by a method comprising subjecting a cold-rolled steel strip added with elements forming carbides and nitrides to a batch annealing and strengthening said strip by the effect of precipitates of said elements forming carbides and nitrides. A steel sheet manufactured by any of such methods has however been problematic in the low productivity and the high manufacturing costs.

As a measure to solve the above-mentioned problems, there is known the following method for manufacturing a high-strength cold-rolled steel sheet through continuous annealing:

(1) A method for manufacturing a high-strength cold-rolled steel sheet excellent in accelerated ageing property, disclosed in Japanese Patent Publication No. 41,983/79 dated Dec. 11, 1979, which comprises:

preparing a steel comprising from 0.04 to 0.12 wt.% carbon and from 0.10 to 1.60 wt.% manganese; then hot-rolling said steel with a finishing temperature of at least 800° C. and a coiling temperature of up to 700° C.; cold-rolling the hot-rolled steel strip after pickling; continuously heating said cold-rolled steel strip to a temperature of from 700° to 900° C.; quenching the same; and then, reheating the same to a temperature of from 150° to 400° C.; holding the same for a prescribed period of time; and then, cooling the same to the room temperature.

According to the above-mentioned method, it is possible to manufacture a high-strength steel at a high productivity with low costs. However, the steel sheet manufactured by this method, having a high tensile strength of from 40 to 80 kg/mm$^2$, has problems because the achievement of such a high tensile strength resulted in a poorer press-formability.

Because of this inconvenience, the application of a high-strength cold-rolled steel sheet to the automobile body is limited to those members particularly requiring a high strength such as a bumper and a guard bar, and the interior members of the car body in which the strain produced during the forming process does not form a difficulty. For the automobile outer shell, which is the most important application of the cold-rolled steel sheet in consumption, an ordinary deep-drawing quality mild cold-rolled steel sheet is used at present, since it is impossible to manufacture a high-strength cold-rolled steel sheet excellent in both press-formability and dent resistance, in spite of the remarkable advantage of using a higher tensile strength steel sheet.

The above-mentioned high-strength cold-rolled steel sheet for automobile outer shell should preferably have a tensile strength of from 35 to 50 kg/mm$^2$. The batch-annealing type phosphorus-containing aluminum-killed cold-rolled steel sheet having a prescribed phosphorus content is known as a cold-rolled steel sheet having the above-mentioned tensile strength, and at the same time, having unimpaired formability. This batch-annealing type P-containing Al-killed cold-rolled steel sheet is manufactured by the utilization of the contribution of the phosphorus content to the achievement of a higher tensile strength without impairing deep drawability. For example, in order to obtain a high-strength cold-rolled steel sheet having a tensile strength of 40 kg/mm$^2$, the phosphorus content should be at least from 0.07 to 0.10 wt.%, and the dissolution of phosphorus in solid-solution form into ferrite brings about a yield strength of from 28 to 30 kg/mm$^2$.

In the above-mentioned batch-annealing type P-containing Al-killed cold-rolled steel sheet, almost no bake-hardening is produced during the baking process of paint. Dent resistance of the batch-annealing type P-containing Al-killed cold-rolled steel sheet is therefore based solely on the above-mentioned yield strength thereof. In addition, in the batch-annealing type P-containing Al-killed cold-rolled steel sheet, when press-formed, the yield strength increased by the addition of phosphorus leads to an increase in the amount of spring-back as well as to the deterioration of shape-freezability. Furthermore, this steel sheet, being manufactured through batch annealing, has problems because of low productivity and increased manufacturing costs.

SUMMARY OF THE INVENTION

An object of the present invention is therefore to provide a method for manufacturing, with high productivity and low costs, a high-strength cold-rolled steel strip which has a satisfactory balance between strength and elongation, is excellent in press-formability and dent resistance, and has a tensile strength of from 35 to 50 kg/mm$^2$.

In accordance with one of the features of the present invention, there is provided a method for manufacturing a high-strength steel strip excellent in press-formability, which comprises the steps of:

preparing a slab of an aluminum-killed steel consisting essentially of, in weight percentage:

| | | |
|---|---|---|
| Carbon | from 0.02 | 0.06%, |
| Manganese | from 0.06 | to 0.25%, |
| phosphorus | from 0.01 | to 0.06%, |
| Soluble aluminum | from 0.020 | to 0.060%, |
| Nitrogen | up to 0.005%, and, | |

the balance iron and incidental impurities;

hot-rolling said slab to prepare a hot-rolled steel strip;

coiling said steel strip at a temperature within the range of from 650° to 770° C.;

cold-rolling said hot-rolled steel strip thus coiled to prepare a cold-rolled steel strip;

subjecting said cold-rolled steel strip to a continuous annealing treatment for a prescribed period of time at a temperature within the range of from 750° to 880° C.;

cooling said cold-rolled steel strip thus continuously annealed at a cooling rate of at least:

$\exp\{-5.6(C\ wt.\%\gamma+Mn\ wt.\%/6+Si\ wt.\%/24)+7.8\}$° C./sec from a temperature region of from $Ar_1$ to $Ar_1+60$° C. to convert the structure thereof into a dual-phase structure of ferrite and a low-temperature transformation phase; and then, subjecting said cold-rolled steel strip having said dual-phase structure to an over-ageing treatment for a prescribed period of time at a temperature within the range of from 260° to 360° C.

DETAILED DESCRIPTION OF PREFERRED EMBODIMENTS

Figure 1:
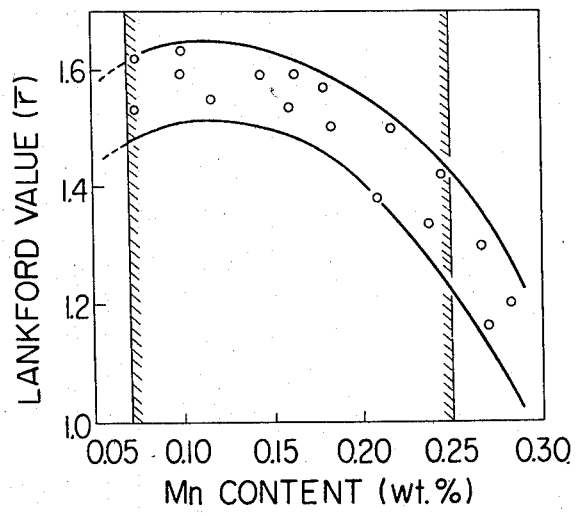
FIG. 1 is a graph illustrating the Lankford value ($\bar{r}$) of a steel sheet as a function of the manganese content in the steel sheet.

With a view to solving the above-mentioned problems, we carried out studies on a method for manufacturing, with low costs and at a high productivity, through continuous annealing, a steel sheet having a formability and a tensile strength well comparable with those of the above-mentioned batch-annealing type P-containing Al-killed cold-rolled steel sheet, with a smaller amount of spring-back during a forming process, and excellent in dent resistance. In these studies, attention was given to the following points in an attempt to impart excellent formability and dent resistance, both of which an automobile outer shell should have, to a high-strength cold-rolled steel sheet manufactured through the above-mentioned continuous annealing:

(1) Improvement of formability:

(a) decreasing yield strength of a steel sheet to a value of up to 30 kg/mm$^2$ to reduce the amount of spring-back produced in the press-formed body resultant from press-forming of the steel sheet;

(b) increasing elongation of the steel sheet to a value of at least 35%;

(c) increasing the Lankford value ($\bar{r}$) of the steel sheet to a value of at least 1.4 to improve the deep-drawability of the steel sheet;

(d) imparting delayed ageing property to the steel sheet.

(2) Improvement of dent resistance:

(a) increasing the increment of yield strength of the press-formed body when said formed body is subjected to paint baking treatment, i.e., the amount of bake-hardening, to a value of at least 5 kg/mm$^2$.

We carried out further studies on measures to impart the above-mentioned properties to a high-strength cold-rolled steel strip manufactured through a continuous annealing, and obtained as a result the following findings:

(1) Measures to decrease yield strength and increase elongation:

Yield strength and elongation are governed principally by the amount of solid-solution elements in ferrite. Therefore, a steel sheet with a low yield strength and a high elongation is obtained by reducing, through the following measures, the amount of substitutional solid-solution elements and interstitial solid-solution elements in ferrite:

(a) employing a grade of steel containing less solid-solution elements;

(b) accelerating the growth of crystal grains; and, (c) applying an over-ageing treatment allowing sufficient precipitation of solid-solution carbon in ferrite.

(2) Measures to increase Lankford value:

It is possible, by the following measures, to manufacture a steel sheet with a high Lankford value even through rapid heating and annealing such as continuous annealing:

(a) reducing the content of substitutional solid-solution elements, particularly that of manganese, to produce recrystallized texture with an appropriate crystal grain size;

(b) coiling the steel strip at a high temperature after hot rolling, to cause nitrogen and carbon dissolved in ferrite in the form of solid solution to precipitate in the form of aluminum nitride and coarse carbide at a stage prior to the continuous annealing; and, (c) coiling the steel strip at a high temperature after hot rolling and subjecting the same to a continuous annealing at a high temperature, to accelerate sufficient growth of recrystallized texture.

(3) Measures to give delayed ageing property:

Reducing the content of solid-solution carbon and solid-solution nitrogen in ferrite, and converting the structure of the steel sheet into a dual-phase structure of ferrite and low-temperature transformation phase, to inhibit appearance of yield elongation along with ageing.

(4) Measures to increase the amount of bake-hardening:

Improvement in yield strength of a press-formed body achieved when applying a paint baking treatment to said press-formed body, i.e., the amount of bake-hardening is directly governed by the amount of solid-solution carbon and solid-solution nitrogen. In order to increase the extent of improvement in yield strength of a press-formed body caused by paint baking, i.e., the amount of bake-hardening, therefore, it is necessary to leave solid-solution carbon and solid solution nitrogen in an appropriate amount in ferrite even at the cost of the above-mentioned elongation and delayed ageing property to some extent.

The present invention was made on the basis of the above-mentioned findings, and the method for manufacturing a high-strength cold-rolled steel strip excellent in press-formability of the present invention comprises the steps of:

preparing a slab of an aluminum-killed steel consisting essentially of, in weight percentage:

| | | |
|---|---|---|
| Carbon | from 0.02 | to 0.06%, |
| Manganese | from 0.06 | to 0.25%, |
| phosphorus | from 0.01 | to 0.06%, |
| Soluble aluminum | from 0.020 | to 0.060%, |
| Nitrogen | up to 0.005%, and, | |

the balance iron and incidental impurities;

hot-rolling said slab to prepare a hot-rolled steel strip;

coiling said steel strip at a temperature within the range of from 650° to 770° C.;

cold-rolling said hot-rolled steel strip thus coiled to prepare a cold-rolled steel strip;

subjecting said cold-rolled steel strip to a continuous annealing treatment for a prescribed period of time at a temperature within the range of from 750° to 880° C.;

cooling said cold-rolled steel strip thus continuously annealed at a cooling rate of at least:

$$\exp\{-5.6(C\ wt.\%\gamma+Mn\ wt.\%/6+Si\ wt.\%/24)+7.8\}\ °C./sec$$

from a temperature region of from $Ar_1$ to $Ar_1+60°$ C. to convert the structure thereof into a dual-phase structure of ferrite and low-temperature transformation phase; and then, subjecting said cold-rolled steel strip having said dual-phase structure to an over-ageing treatment for a prescribed period of time at a temperature within the range of from 260° to 360° C.

Now, we will describe hereinbelow the reasons why the grade of steel and the chemical composition are limited to those mentioned above in the present invention.

(A) Aluminum-killed steel:

The grade of steel to be used is limited to aluminum-killed steel to inhibit ageing caused by nitrogen through fixation of nitrogen in steel in the form of aluminum nitride, and to prevent solid-solution nitrogen from impairing smooth formation of recrystallization nuclei during the continuous annealing process.

(B) Carbon:

Carbon has the effect of being dissolved into ferrite to increase strength and enhance hardenability of the steel. It is thus possible to strengthen a steel sheet through quenching of a steel strip after continuous annealing and conversion of the structure into a dual-phase structure. However, with a carbon content of under 0.02 wt.%, a desired effect as mentioned above cannot be obtained. With a carbon content of over 0.06 wt.%, on the other hand, yield strength of the steel sheet increases beyond the target upper limit of 30 kg/mm$^2$, with a decreased value of elongation, and there is only insufficient generation of the recrystallized texture with an appropriate grain size acting favorably on deep-drawability. The carbon content should therefore be within the range of from 0.02 to 0.06 wt.%.

(C) Manganese:

Manganese has the effect of strengthening a steel sheet, as in carbon, through quenching of a steel strip after continuous annealing and conversion of the structure into a dual-phase structure. However, with a manganese content of under 0.06 wt.%, a desired effect as mentioned above cannot be obtained. With a manganese content of over 0.25 wt.%, on the other hand, yield strength of the steel sheet increases beyond the target upper limit of 30 kg/mm$^2$, with a decreased value of elongation, and there is only insufficient generation of the recrystallized texture with an appropriate grain size acting favorably on deep-drawability. Manganese has an important effect particularly on the Lankford value ($\bar{r}$) of steel sheet. FIG. 1 is a graph illustrating the Lankford value (r) of steel sheets manufactured with various contents of manganese under the following conditions:

Carbon content: 0.03 wt.%,

Manganese content: several levels within the range of from 0.05 to 0.30 wt.%,

Coiling temperature of steel strip after hot rolling: 750° C.,

Continuous annealing conditions: at a temperature of 850° C. for a period of 90 seconds, Over-ageing conditions: at a temperature of 350° C. for a period of 3 minutes.

As is clear from FIG. 1, with a manganese content of over 0.25 wt.%, the Lankford value ($\bar{r}$) seriously decreases to below the target lower limit of 1.4. The manganese content should therefore be within the range of from 0.06 to 0.25 wt.%.

(D) Phosphorus:

Phosphorus has the effect of increasing the strength of a steel sheet without imparing formability, especially deep-drawability. However, with a phosphorus content of under 0.01 wt.%, a desired effect as mentioned above cannot be obtained. With a phosphorus content of over 0.06 wt.%, on the other hand, yield strength of the steel sheet increases beyond the target upper limit of 30 kg/mm$^2$. The phosphorus content should therefore be within the range of from 0.01 to 0.06 wt.%.

(E) Soluble aluminum:

Soluble aluminum has the effect of causing precipitation of nitrogen in steel in the form of aluminum nitride. However, with a soluble aluminum content of under 0.020 wt.%, a desired effect as mentioned above cannot be obtained. With a soluble aluminum content of over 0.060 wt.%, on the other hand, alumina inclusions cause surface defects on the steel sheet. The soluble aluminum content should therefore be within the range of from 0.020 to 0.060 wt.%.

(F) Nitrogen:

Nitrogen precipitates in the form of aluminum nitride through reaction with the above-mentioned soluble aluminum. However, with a nitrogen content of over 0.005 wt.%, it becomes necessary to add aluminum in a large quantity, thus resulting in the production of surface defects on the steel sheet under the effect of alumina inclusions. The nitrogen content should therefore be up to 0.005 wt.%.

(G) Silicon:

Silicon, which has the effect of further improving strength of a steel sheet having the chemical composition described in (A) to (F) avove, is added as required. However, with a silicon content of over 0.20 wt.%, the Lankford value $\overline{(r)}$ of the steel sheet decreases. The silicon content should therefore be up to 0.20 wt.%.

Now, we will describe hereinbelow the reasons why the coiling temperature of the hot-rolled steel strip and the heat treatment conditions of the cold-rolled steel strip are limited as mentioned above.

(A) Coiling temperature:

In order to cause production of a recrystallized texture which increases the Lankford value $\overline{(r)}$ of the steel sheet, it is necessary to cause precipitation of nitrogen in steel in the form of aluminum nitride and to reduce the extent of remelting of carbides at the time of heating during continuous annealing. This requires coiling of the steel strip at a high temperature after hot rolling.

Figure 2:
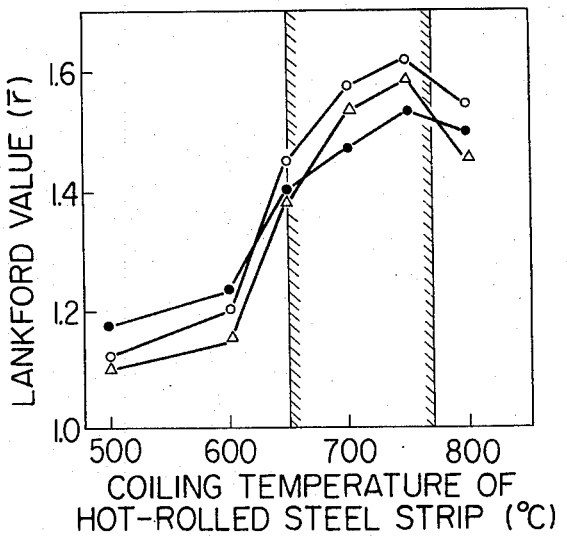
FIG. 2 is a graph illustrating the Lankford value ($\bar{r}$) of a steel sheet as a function of the coiling temperature of a hot-rolled steel strip.

FIG. 2 is a graph illustrating the Lankford value (r) as a function of the following conditions, particularly of the coiling temperature of the steel strip:

Carbon content: 0.03 wt.%,

Manganese content: 0.07 wt.% (white circles in the graph), 0.10 wt.% (triangles in the graph), 0.16 wt.% (black circles in the graph), Coiling temperature of steel strip after hot rolling: several levels within the range of from 500° to 800° C., Continuous annealing conditions: at a temperature of 850° C. for a period of 90 seconds, Over-ageing conditions: at a temperature of 350° C. for a period of 3 minutes.

As is clear from FIG. 2, with a coiling temperature of steel strip of under 650° C., the Lankford value $\overline{(r)}$ does not in some cases reach the target value of 1.4. With a coiling temperature of steel strip of over 770° C., on the other hand, coarse grains tend to easily occur, and much scale is produced on the steel strip, thus impairing the pickling property thereof. The coiling temperature of steel strip after hot rolling should therefore be within the range of from 650° to 770° C.

Figure 3:
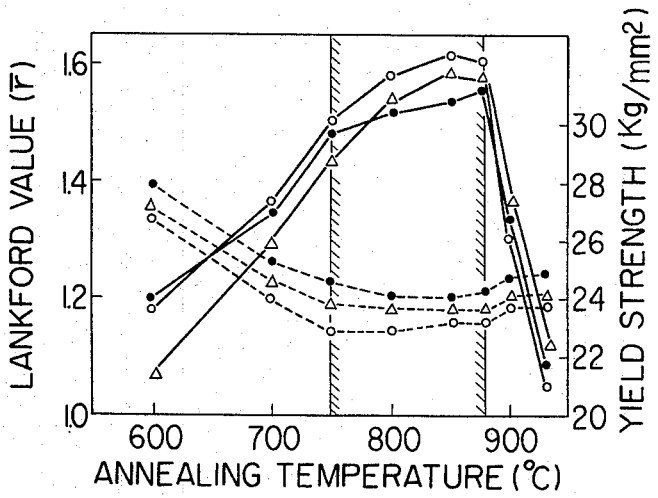
FIG. 3 is a graph illustrating the Lankford value ($\bar{r}$) and yield strength of a steel sheet as functions of the annealing temperature of a cold-rolled steel strip.

(B) Continuous annealing conditions:

When subjecting a cold-rolled steel strip to a continuous annealing, it is necessary to promote formation of a recrystallized texture with an appropriate grain size, reduce yield strength and thus ensure optimum conditions for improving elongation and deep-drawability. FIG. 3 is a graph illustrating the Lankford valve $\overline{(r)}$ and yield strength of a steel sheet manufactured by varying the following conditions, especially the annealing temperature.

Carbon content: 0.03 wt.%,

Manganese content: 0.07 wt.% (white circles in the graph), 0.10 wt.% (triangles in the graph), 0.16 wt.% (black circles in the graph), Coiling temperature of steel strip after hot rolling: 750° C.

Continuous annealing conditions:

Temperature: several levels within the range of from 600° to 1,000° C.,

Period: 90 seconds,

Over-ageing conditions: at a temperature of 350° C. for a period of 3 minutes.

In FIG. 3, the solid line represents the Lankford value (r), and the dotted line shows yield strength. As is evident from FIG. 3, at an annealing temperature of under 750° C., a sufficient growth of ferrite grains requires a long period of time, and a continuous annealing for such a short period of time as 90 seconds cannot give a high Lankford valve $\overline{(r)}$ of at least 1.4. At an annealing temperature of over 880° C., on the other hand, the temperature becomes closer to the normalizing temperature level, and a recrystallized texture with an appropriate grain size cannot be obtained, with sudden decrease in the Lankford value $\overline{(r)}$, resulting in the increase in manufacturing costs. In addition, at an annealing temperature of under 750° C. or over 880° C., yield strength shows an increasing tendency more than required, and this is not desirable. The annealing temperature should therefore be within the range of from 750° to 880° C.

With a view of ensuring growth of appropriate ferrite grains, it is necessary to provide an annealing period of at least 30 seconds. With an annealing period of over 5 minutes, however, no remarkable effect in quality is observed, leading only to larger-scale equipment. The annealing period should therefore preferably be within the range of from 30 seconds to 5 minutes.

(C) Cooling conditions:

Cooling of the steep strip after continuous annealing requires conditions for dissolving into ferrite an amount of carbon sufficient to improve yield strength of the press-formed body during paint baking process of said press-formed body, and for converting the structure into a dual-phase structure of ferrite and low-temperature transformation phase. Structure of steel is converted into a dual-phase structure of ferrite and low-temperature transformation phase in an attempt to increase the strength of the steel sheet, and inhibit appearance of yield elongation resulting from ageing, thus imparting the delayed ageing property to the steel sheet.

Figure 4:
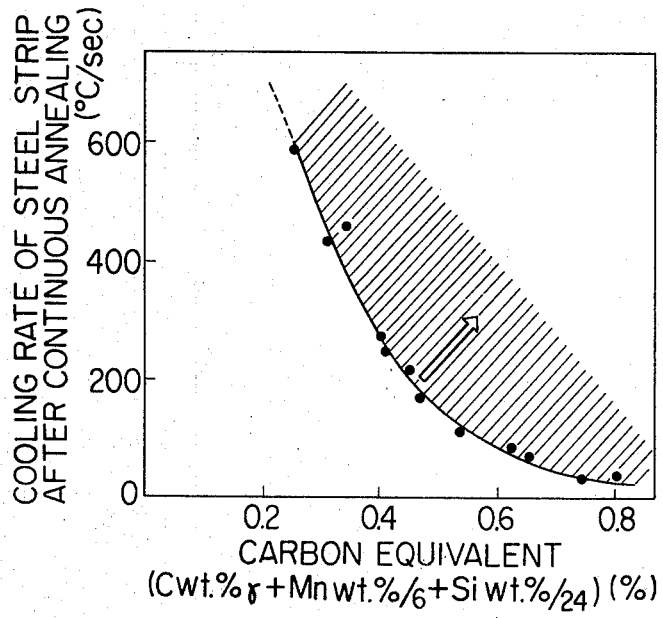
FIG. 4 is a graph illustrating the cooling rate of a steel strip after a continuous annealing for converting the structure of the resultant steel sheet into a dual-phase structure of ferrite and low-temperature transformation phase; and, FIG. 5 is a graph illustrating the amount of bake-hardening of paint, elongation and internal friction of a steel sheet as functions of the over-ageing temperature of the steel strip.

FIG. 4 is a graph illustrating the relationship between the carbon equivalent and the cooling rate, in which the abscissa represents the carbon equivalent (C wt.%$\gamma$+Mn wt.%/6+Si wt.%/24) and the ordinate indicates the cooling rate (°C./sec). C wt.%$\gamma$ in the carbon equivalent represents the carbon concentration in austenite of the second phase within the temperature region of from $Ar_1$ to $Ar_1+60°$ C., which is the quench-starting temperature of the steel strip to achieve the above-mentioned dual-phase structure. This carbon concentration is approximated by {[831—quench-starting temperature (°C.)]/135}%.

The curve given in FIG. 4 represents the lower critical cooling rate giving the lower limit of cooling rate for converting the structure of steel into the above-mentioned dual-phase structure. In order to impart the bake-hardenability to a steel sheet, it suffices to cool the steel strip after continuous annealing at a rate of at least 20° C./sec, whereas, in order to convert the structure of steel into the above-mentioned dual-phase structure, it is necessary to cool the steel strip at a rate of at least that represented by the curve in FIG. 4 (within the region shown by oblique lines). The lower critical cooling rate shown by the curve in FIG. 4 can be expressed by the following formula:

exp{−5.6(C wt.%γ+Mn wt.%/6+Si wt.%/24)+7.8}°C./sec.

In the above-mentioned dual-phase structure of ferrite and low-temperature transformation phase, the volume ratio of the low-temperature transformation phase should preferably be up to 10% of the structure as a whole. A volume ratio of the low-temperature transformation phase of over 10% of the structure as a whole is not desirable because of the increase in yield strength and the decrease in elongaion. The upper limit of the quench-starting temperature is set at $Ar_1+60°$ C. to limit the volume ratio of the low-temperature transformation phase in the above-mentioned dual-phase structure to up to 10% of the structure as a whole. The steel strip after continuous annealing should therefore be quenched at a cooling rate of at least:

Exp{−5.6(C wt.%γ+Mn wt.%/6+Si wt.%/24)+7.8}°C./sec from the temperature region of from $Ar_1$ to $Ar_1+60°$ C.

Figure 5:
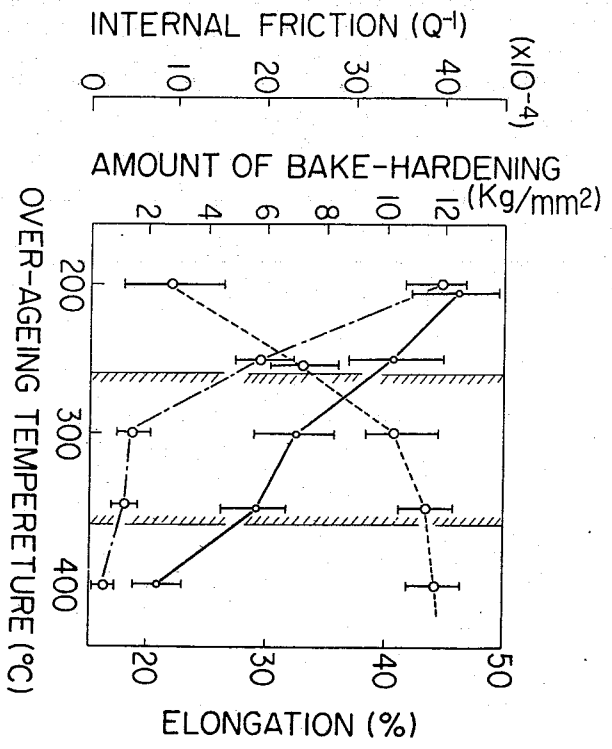

(D) Over-ageing conditions:

When applying an over-ageing treatment to a steel strip after continuous annealing, it is necessary to provide conditions to reduce the decrease in elongation and the increase in yield strength caused by solid-solution carbon dissolved in ferrite to saturation through cooling after annealing, and to leave in ferrite the solid-solution carbon which contributes to the increase in yield strength during paint baking of the press-formed body. FIG. 5 is a graph illustrating the increment of yield strength during paint baking, i.e., the amount of bake-hardening, elongation, and the value of solid-solution carbon content after annealing as measured in terms of internal friction, i.e., the value of internal friction in the case where an over-ageing treatment is applied for a period of 3 minutes, altering the over-ageing temperature within the range of from 200° to 400° C., to steel sheets manufactured under such conditions as the carbon content, the manganese content, the coiling temperature of steel strip after hot rolling, continuous annealing conditions, and cooling conditions after continuous annealing, within the above-mentioned ranges of conditions of the present invention. The amount of bake-hardening is defined as the amount of hardening produced under ordinary paint baking conditions (a heating temperature of from 100° to 200° C. and a heating time of from 10 to 20 minutes) when applying a paint to a press-formed steel sheet.

In FIG. 5, the solid line represents the amount of bake-hardening, the dotted line represents the value of elongation, and the chain line represents the value of internal friction. As is clear from FIG. 5, an over-ageing temperature of under 260° C. is not desirable since the resultant insufficient precipitaion of solid-solution carbon leads to a low value of elongation of up to 35% in spite of the large amount of bake-hardening and the internal friction is as high as over $5\times10^{-4}$. At an over-ageing temperature of over 360° C., on the other hand, the solid-solution carbon in ferrite almost totally precipitates, leading to a satisfactory elongation, whereas the amount of bake-hardening is so low as under 5 kg/mm$^2$. Therefore, the over-ageing temperature simultaneously satisfying an amount of bake-hardening of at least 5 kg/mm$^2$, an elongation of at least 35%, and an internal friction of up to $5\times10^{-4}$ should be within the range of from 260° to 360° C. The period of time for effectively carrying out an over-ageing treatment within the above-mentioned temperature range should preferably be within the range of from 1 to 10 minutes.

Now, the present invention is described in more detail with reference to an example.

EXAMPLE

Six kinds of steels of the present invention "A" to "F" and two kinds of reference steels "G" and "H" based on the conventional batch-annealing type P-containing Al-killed steel, having respective chemical compositions as shown in Table 1, where prepared by the ordinary steelmaking process. The steels of the present invention "A" to "D" and the reference steels "G" and "H" were cast into ingots immediately after steelmaking. The steels of the present invention "E" and "F" were subjected to a slight degassing treatment after steelmaking to reduce the carbon and nitrogen contents in the steel, and then cast into ingots. Although casting is possible either by ingot casting or continuous casting, these steels in this example were cast by ingot casting.

TABLE 1

(wt. %)

| Kind of steel | Symbol | C | Si | Mn | P | S | Sol. Al | N |
|---|---|---|---|---|---|---|---|---|
| Steel of the present invention | A | 0.060 | tr | 0.15 | 0.030 | 0.010 | 0.044 | 0.0040 |
| | B | 0.048 | 0.020 | 0.15 | 0.030 | 0.022 | 0.038 | 0.0039 |
| | C | 0.040 | 0.014 | 0.16 | 0.010 | 0.015 | 0.046 | 0.0048 |
| | D | 0.037 | tr | 0.18 | 0.018 | 0.020 | 0.030 | 0.0050 |
| | E | 0.030 | tr | 0.10 | 0.050 | 0.012 | 0.040 | 0.0021 |
| | F | 0.020 | tr | 0.14 | 0.020 | 0.008 | 0.029 | 0.0018 |
| Reference steel | G | 0.045 | 0.20 | 0.25 | 0.078 | 0.007 | 0.038 | 0.0040 |
| | H | 0.055 | 0.27 | 0.28 | 0.086 | 0.005 | 0.040 | 0.0038 |

The ingots thus cast were rolled into slabs having a thickness of from 120 to 200 mm on a slabbing mill. Then, after heating to 1,250° C., these slabs were hot-rolled into steel strips having a thickness of 2.8 mm on a roughing mill and a finishing mill, and then coiled into coils. The steels of the present invention "A" to "F" were coiled at a coiling temperature of 700° C., and the reference steels "G" and "H" were coiled at a temperature of 550° C. Then, after a pickling treatment, said steel strips were cold-rolled into steel strips having a thickness of 0.7 mm on a cold rolling mill.

Then, these cold-rolled steel strips were annealed as follows:

(A) The steels of the present invention "A" to "F":

The cold-rolled steel strip was heated to 850° C. in a continuous annealing furnace and held at this temperature for 90 seconds. Then, the steel strip was cooled to 750° C. by a gas jet, and immediately after cooling, dipped into a water jet in a cooling tank to quench at a rate of about 2000° C./sec. Then, the steel strip thus quenched was heated to 300° C., and held at this temperature for 3 minutes to apply an over-ageing treatment to the steel strip.

(B) Reference steels "G" and "H":

The steel strip was heated in a box-type annealing furnace to 700° C. at a heating rate of 100° C./hr, held at this temperature for three hours, and then cooled in the furnace.

The steels thus subjected to heat treatment were then subjected to temper rolling with an elongation percentage of 1%. Table 2 gives values of tensile test results and Lankford values of the steels after temper rolling. As shown in Table 2, the steels of the present invention had values of tensile strength and elongation almost identical with those of the reference steels. The steels of the present invention were far low in yield strength and more excellent in press-formability than the reference steels. In addition, the steels of the present invention had Lankford values well comparable with those of the reference steels and were provided with an excellent deep-drawability.

TABLE 2

| Kind of steel | Symbol | Tensile test value: Yield strength (kg/mm²) | Yield Elongation (%) | Tensile strength (kg/mm²) | Elongation (%) | n-value | Lankford value: $r_L$ | $r_D$ | $r_C$ | $\bar{r}$ |
|---|---|---|---|---|---|---|---|---|---|---|
| Steel of the present invention | A | 30.0 | 0 | 47.8 | 36.9 | 0.194 | 1.38 | 1.16 | 1.81 | 1.43 |
| | B | 26.7 | 0 | 42.5 | 38.2 | 0.201 | 1.50 | 1.32 | 1.80 | 1.49 |
| | C | 24.5 | 0 | 38.4 | 41.0 | 0.211 | 1.59 | 1.36 | 1.77 | 1.52 |
| | D | 22.8 | 0 | 37.7 | 41.1 | 0.207 | 1.70 | 1.39 | 1.86 | 1.59 |
| | E | 24.8 | 0 | 39.2 | 40.6 | 0.213 | 1.62 | 1.41 | 1.88 | 1.58 |
| | F | 21.9 | 0 | 35.8 | 45.3 | 0.228 | 1.79 | 1.41 | 1.98 | 1.65 |
| Reference steel | G | 29.5 | 0 | 39.7 | 41.3 | 0.191 | 1.80 | 1.40 | 2.08 | 1.67 |
| | H | 30.6 | 0 | 40.5 | 38.6 | 0.190 | 1.76 | 1.36 | 1.90 | 1.60 |

Then, a test was carried out on the steels prepared by the above-mentioned methods to determine changes in mechanical properties when press-forming these steels and applying paint baking to these press-formed bodies. The test was carried out, after applying a 2% tensile strain, by heating the steels at a temperature of 170° C. for 20 minutes to determine mechanical properties of these steels. Mechanical properties of the steels were investigated also after temper rolling with an elongation percentage of 1% and then ageing by holding at a temperature of 38° C. for 8 days.

Table 3 gives tensile test values showing the results of the above-mentioned test.

TABLE 3

| Kind of steel | Symbol | Tensile test value after applying 2% strain and a paint bake-hardening: Yield strength (kg/mm²) | Tensile strength (kg/mm²) | Elongation (%) | Increment in yield strength (kg/mm²) | Tensile test value after ageing at 38° C. for 8 days: Yield strength (kg/mm²) | Yield elongation (%) | Tensile strength (kg/mm²) | Elongation (%) | n-value |
|---|---|---|---|---|---|---|---|---|---|---|
| Steel of the present invention | A | 41.3 | 48.5 | 30.5 | 11.3 | 31.4 | 0 | 47.9 | 36.0 | 0.172 |
| | B | 37.1 | 43.0 | 32.1 | 10.4 | 26.9 | 0 | 42.3 | 37.9 | 0.180 |
| | C | 33.1 | 38.9 | 34.6 | 8.6 | 25.1 | 0 | 38.5 | 40.2 | 0.186 |
| | D | 32.4 | 38.2 | 35.0 | 9.6 | 23.6 | 0 | 37.5 | 39.8 | 0.176 |
| | E | 33.6 | 39.7 | 34.3 | 8.8 | 25.5 | 0 | 39.5 | 40.0 | 0.191 |
| | F | 30.6 | 36.2 | 40.1 | 8.7 | 22.3 | 0 | 36.0 | 44.8 | 0.198 |
| Reference steel | G | 32.8 | 40.3 | 35.6 | 3.3 | 29.8 | 0 | 39.9 | 40.8 | 0.182 |
| | H | 34.1 | 41.2 | 33.5 | 3.5 | 30.9 | 0 | 40.6 | 38.3 | 0.184 |

As shown in Table 3, for the steels of the present invention, yield strength is improved by a value within the range of from 5 to 15 kg/mm² through application of a paint baking, and the increase in yield strength showed a very high value as compared with the reference steels. As a result, in the steels of the present invention, yield strength increased to a value equal to or even higher than that of the reference steels, with an improved tensile strength as well. In addition, the steels of the present invention were found to produce no yield elongation even after ageing at 38° C. for 8 days, and to be excellent in delayed ageing property.

According to the method of the present invention, as described above in detail, it is possible to manufacture, at a high productivity and with low costs, a high-strength cold-rolled steel sheet which has a tensile strength of from 35 to 50 kg/mm² as required for such applications as automoble outer shell, is satisfactory in elongation as well as in Lankford value, and excellent also in press-formability and dent resistance, thus providing industrially useful effects.

What is claimed is:

1. An improved process for manufacturing a high-strength cold-rolled steel strip excellent in press-formability, which comprises the steps of:

preparing a slab of an aluminum-killed steel consisting essentially of, in weight percentage:

| | | |
|---|---|---|
| Carbon | from 0.02 | to 0.06%, |
| Manganese | from 0.06 | to 0.25%, |
| phosphorus | from 0.01 | to 0.06%, |
| Soluble aluminum | from 0.020 | to 0.060%, |
| Nitrogen | up to 0.005%, and, | |

the balance iron and incidental impurities;

hot-rolling said slab to prepare a hot-rolled steel strip;

coiling said steel strip at a temperature within the range of from 650° to 770° C.;

cold-rolling said hot-rolled steel strip thus coiled to prepare a cold-rolled steel strip;

subjecting said cold-rolled steel strip to a continuous annealing treatment for a prescribed period of time at an annealing temperature within the range of from 750° to 880° C.;

subjecting said cold-rolled steel strip thus continuously annealed to a quenching treatment at a prescribed cooling rate; and then, subjecting said cold-rolled steel strip to an overaging treatment for a prescribed period of time at a prescribed temperature;

the improvement comprising:

cooling said cold-rolled steel strip subjected to said continuous annealing treatment from said annealing temperature to a temperature region of from $Ar_1$ to $Ar_1+60°$ C. by blowing a gas jet onto said cold-rolled steel strip; then, carrying out said quenching treatment at a cooling rate of at least;

$\exp\{-5.6(C\ wt.\%\gamma+MN\ wt.\%/6+Si\ wt.\%/24)+7.8\}$° C./sec from said temperature region of from $Ar_1$ to $Ar_1+60°$ C. to convert the structure of said cold-rolled steel strip into a dual-phase structure comprising a ferrite phase of at least 90 vol.% and a low-temperature transformation phase of up to 10 vol.%; and then, applying said over-aging treatment at a temperature within the range of from 260° to 360° C.;

thereby forming said cold-rolled steel strip having a Lankford value of at least 1.4.

2. The process of claim 1, wherein said slab of said aluminum-killed steel additionally contains up to 0.2 wt% silicon.

3. The process of claim 1 or 2, wherein said continuous annealing treatment is effected for a period of time within the range of from 30 seconds to 5 minutes.

4. The process of claim 1 or 2, wherein said over-aging treatment is effected for a period of time within the range of from 1 to 10 minutes.

5. The process of claim 1 or 2, wherein said steel strip subjected to said over-aging treatment is press-formed, and the resultant press-formed body is subjected to a paint baking treatment, thereby improving yield strength of said press-formed body by a value within the range of from 5 to 15 kg/mm$^2$.

6. The process of claim 3, wherein said over-aging treatment is effected for a period of time within the range of from 1 to 10 minutes.

7. The process of claim 3, wherein said steel strip subjected to said over-aging treatment is press-formed, and the resultant press-formed body is subjected to a paint baking treatment, thereby improving yield strength of said press-formed body by a value within the range of from 5 to 15 kg/mm$^2$.

8. The process of claim 1, wherein said steel strip subjected to said over-aging treatment is press-formed, and the resultant press-formed body is subjected to a paint baking treatment, thereby improving yield strength of said press-formed body by a value within the range of from 5 to 15 kg/mm$^2$.

9. The process of claim 6, wherein said steel strip subjected to said over-aging treatment is press-formed, and the resultant press-formed body is subjected to a paint baking treatment, thereby improving yield strength of said press-formed body by a value within the range of from 5 to 15 kg/mm$^2$.

* * * * *

UNITED STATES PATENT AND TRADEMARK OFFICE

CERTIFICATE OF CORRECTION

PATENT NO. : 4,336,080

DATED : June 22, 1982

INVENTOR(S) : KAZUHIDE NAKAOKA et al

It is certified that error appears in the above—identified patent and that said Letters Patent is hereby corrected as shown below:

Column 12, line 60: rewrite "overaging" as --over-aging--.

Column 14, line 14: after "claim" replace "1" with --4--.

Signed and Sealed this

*Eleventh* Day of *January 1983*

[SEAL]

*Attest:*

GERALD J. MOSSINGHOFF

*Attesting Officer* *Commissioner of Patents and Trademarks*